US009609956B1

(12) United States Patent
Lin

(10) Patent No.: US 9,609,956 B1
(45) Date of Patent: Apr. 4, 2017

(54) INFLATABLE AIR CUSHION

(71) Applicant: FENG YI OUTDOOR LEISURE EQUIPMENT ENTERPRISE CO., LTD., Taichung (TW)

(72) Inventor: Ping-Ting Lin, Taichung (TW)

(73) Assignee: Feng Yi Outdoor Leisure Equipment Enterprise Co., Ltd., Taichung (TW)

( * ) Notice: Subject to any disclaimer, the term of this patent is extended or adjusted under 35 U.S.C. 154(b) by 0 days.

(21) Appl. No.: 14/979,435

(22) Filed: Dec. 27, 2015

(51) Int. Cl.
*A47C 27/08* (2006.01)
*A47C 21/04* (2006.01)

(52) U.S. Cl.
CPC ..... *A47C 27/081* (2013.01); *A47C 21/048* (2013.01)

(58) Field of Classification Search
CPC ..... A47C 27/08
USPC ..... 5/706, 712, 417
See application file for complete search history.

(56) References Cited

U.S. PATENT DOCUMENTS 8,146,184 B2 * 4/2012 Lin ..... A47C 21/048 5/417
2002/0083528 A1 * 7/2002 Fisher ..... A47C 27/087 5/706
2007/0000048 A1 * 1/2007 Davis ..... A61G 7/1021 5/81.1 R

* cited by examiner

*Primary Examiner* — Fredrick Conley
(74) *Attorney, Agent, or Firm* — Alan D. Kamrath; Kamrath IP Lawfirm, P.A.

(57) ABSTRACT

An air cushion includes a cushion body and an air nozzle. The cushion body includes an upper surface layer, a lower surface layer, an upper plastic film layer, a lower plastic film layer, a plurality of pull straps, and a warming layer. Each of the pull straps has an upper end provided with a first connecting portion and a lower end provided with a second connecting portion. The first connecting portion and the second connecting portion of each of the pull straps are provided with a plurality of bonding portions. The warming layer is located between the upper surface layer and the first connecting portion of each of the pull straps and is provided with a plurality of through holes aligning with the bonding portions.

9 Claims, 9 Drawing Sheets

INFLATABLE AIR CUSHION

BACKGROUND OF THE INVENTION

1. Field of the Invention

The present invention relates to an air cushion and, more particularly, to an air cushion that can be inflated and deflated.

2. Description of the Related Art

A conventional inflatable air cushion in accordance with the prior art shown in FIGS. 9-11 comprises a cushion body 90 and an air nozzle 97 mounted on the cushion body 90. The cushion body 90 includes an upper surface layer 91, a lower surface layer 92 combined with the upper surface layer 91, a plurality of pull straps 95 mounted between the upper surface layer 91 and the lower surface layer 92, an upper plastic film layer 93 mounted on an inner wall of the upper surface layer 91, and a lower plastic film layer 94 mounted on an inner wall of the lower surface layer 92 and combined with the upper plastic film layer 93. The pull straps 95 are parallel with each other to form a plurality of air channels 96 between the upper surface layer 91 and the lower surface layer 92. In use, when the air nozzle 97 is opened, the ambient air is introduced through the air nozzle 97 into the cushion body 90 so that the air flows through the air channels 96 of the cushion body 90 to inflate and expand the cushion body 90 for use with a user. Thus, the cushion body 90 can be used outdoors for camping, mountaineering and the like. However, the cushion body 90 does not have a warming effect so that when a user lies on the upper surface layer 91 of the cushion body 90, the moisture of the ground or earth will be infiltrated through the lower surface layer 92 into the upper surface layer 91, thereby causing an uncomfortable sensation to the user.

BRIEF SUMMARY OF THE INVENTION

The primary objective of the present invention is to provide an inflatable air cushion having a warming function.

In accordance with the present invention, there is provided an air cushion comprising a cushion body and an air nozzle mounted on the cushion body. The cushion body includes an upper surface layer, a lower surface layer juxtaposed to the upper surface layer, an upper plastic film layer mounted on the upper surface layer, a lower plastic film layer mounted on the lower surface layer and combined with the upper plastic film layer, a plurality of pull straps mounted between the upper surface layer and the lower surface layer, and a warming layer mounted between the upper surface layer and the lower surface layer. Each of the pull straps has an upper end provided with a first connecting portion and a lower end provided with a second connecting portion. The first connecting portion and the second connecting portion of each of the pull straps are provided with a plurality of bonding portions between the upper plastic film layer of the upper surface layer and the lower plastic film layer of the lower surface layer. The warming layer is located between the upper surface layer and the first connecting portion of each of the pull straps. The warming layer is provided with a plurality of through holes.

According to the primary advantage of the present invention, the warming layer of the cushion body provides a warming function to the user to maintain the warming effect exactly and efficiently.

According to another advantage of the present invention, the bonding portions align with the through holes of the warming layer so that when the first connecting portion of each of the pull straps and the upper plastic film layer of the upper surface layer are connected by the bonding portions, the through holes of the warming layer will not interfere with connection of the first connecting portion and the upper plastic film layer, so as to achieve an exact bonding connection.

According to a further advantage of the present invention, the warming layer is placed on and limited by the first connecting portion of each of the pull straps, and the through holes of the warming layer are limited by the bonding portions between the first connecting portion of each of the pull straps and the upper plastic film layer of the upper surface layer, so that the warming layer is positioned and will not be moved, thereby preventing inflation of the cushion body from being affected by the warming layer.

According to a further advantage of the present invention, the ambient air is introduced through the air nozzle into the cushion body and is evenly circulated through the channels between the pull straps and the cushion body and through the slots of each of the pull straps so that the cushion body is inflated easily and quickly.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
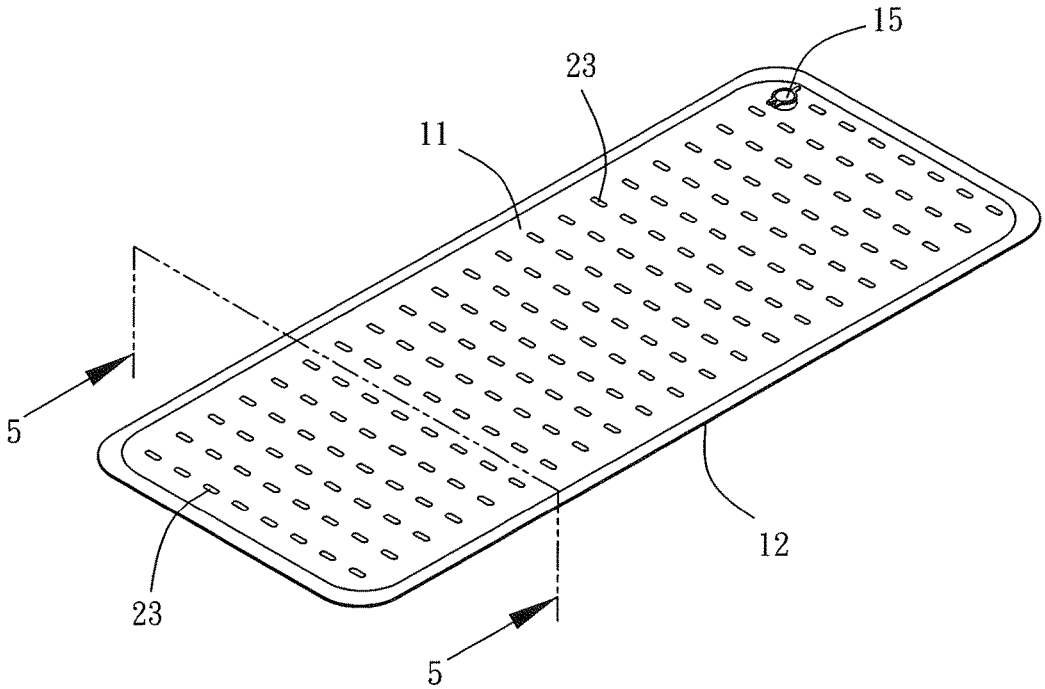
FIG. 1 is a perspective view of an air cushion in accordance with the preferred embodiment of the present invention.
Figure 2:
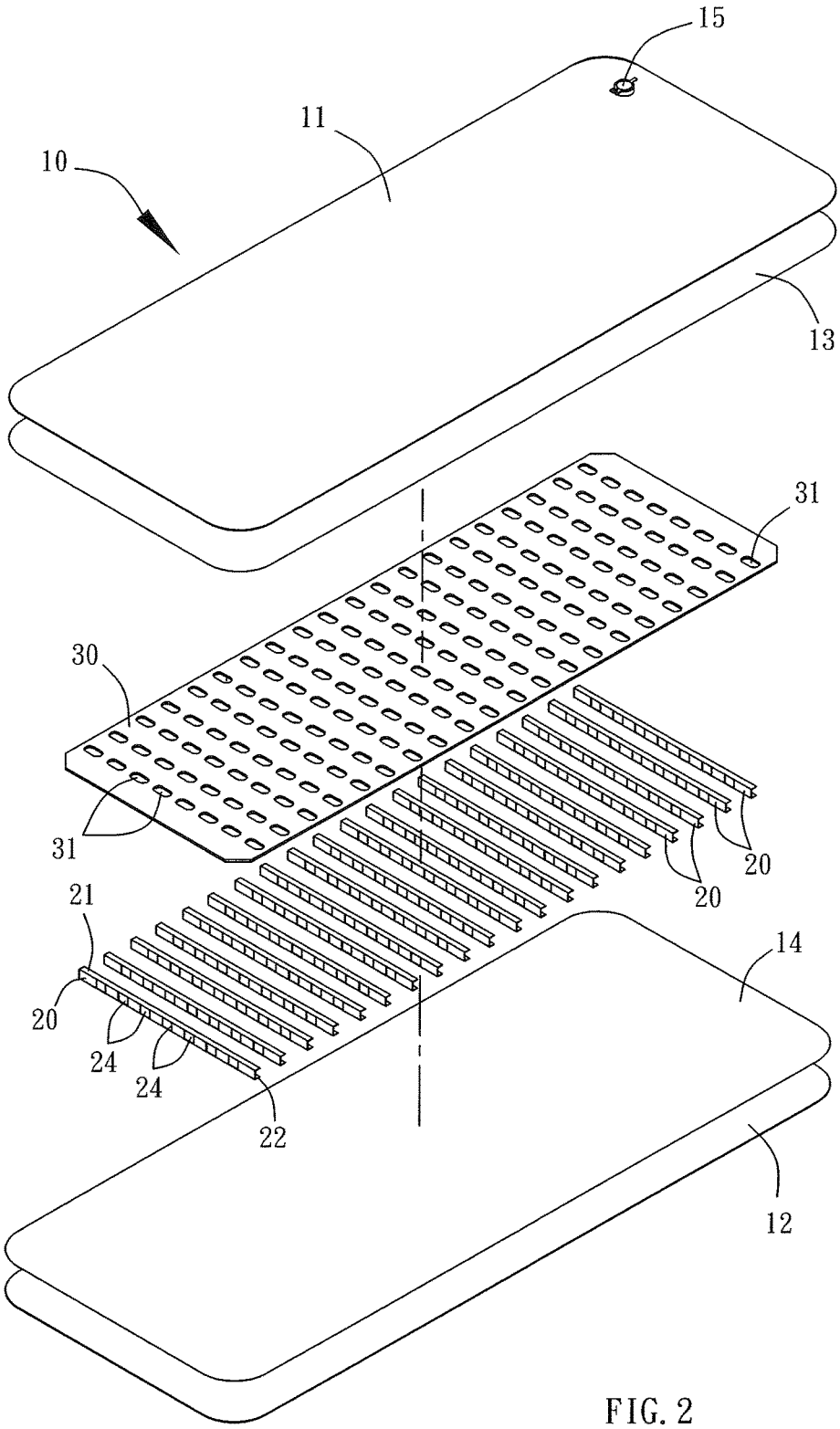
FIG. 2 is an exploded perspective view of the air cushion as shown in FIG. 1.
Figure 3:
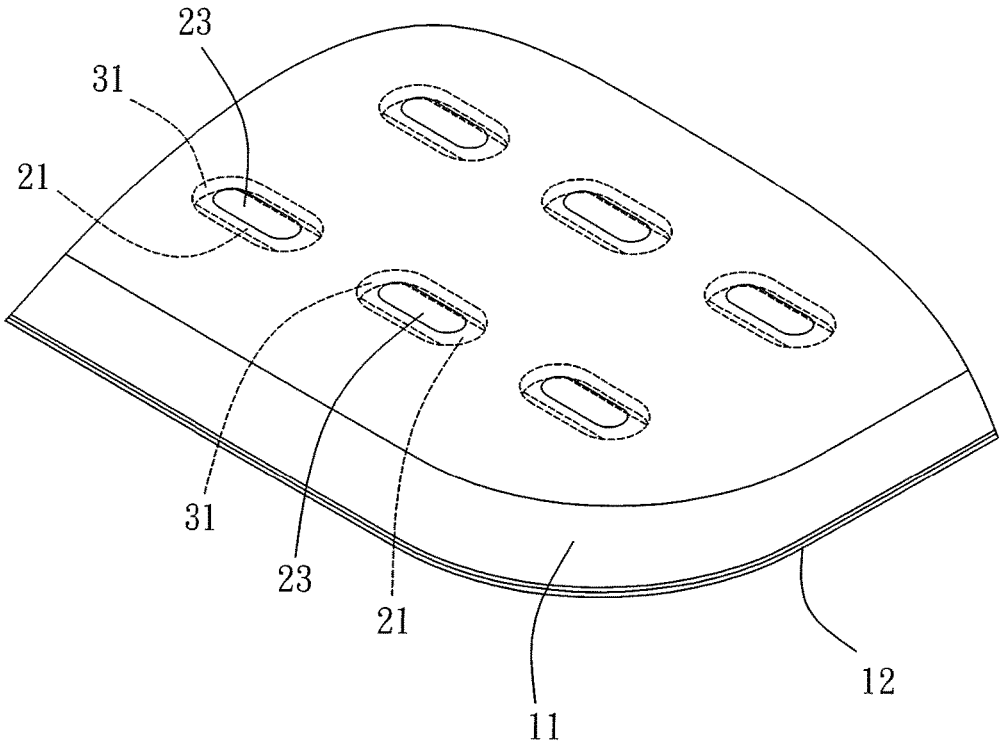
FIG. 3 is a locally enlarged perspective view of the air cushion as shown in FIG. 1.
Figure 4:
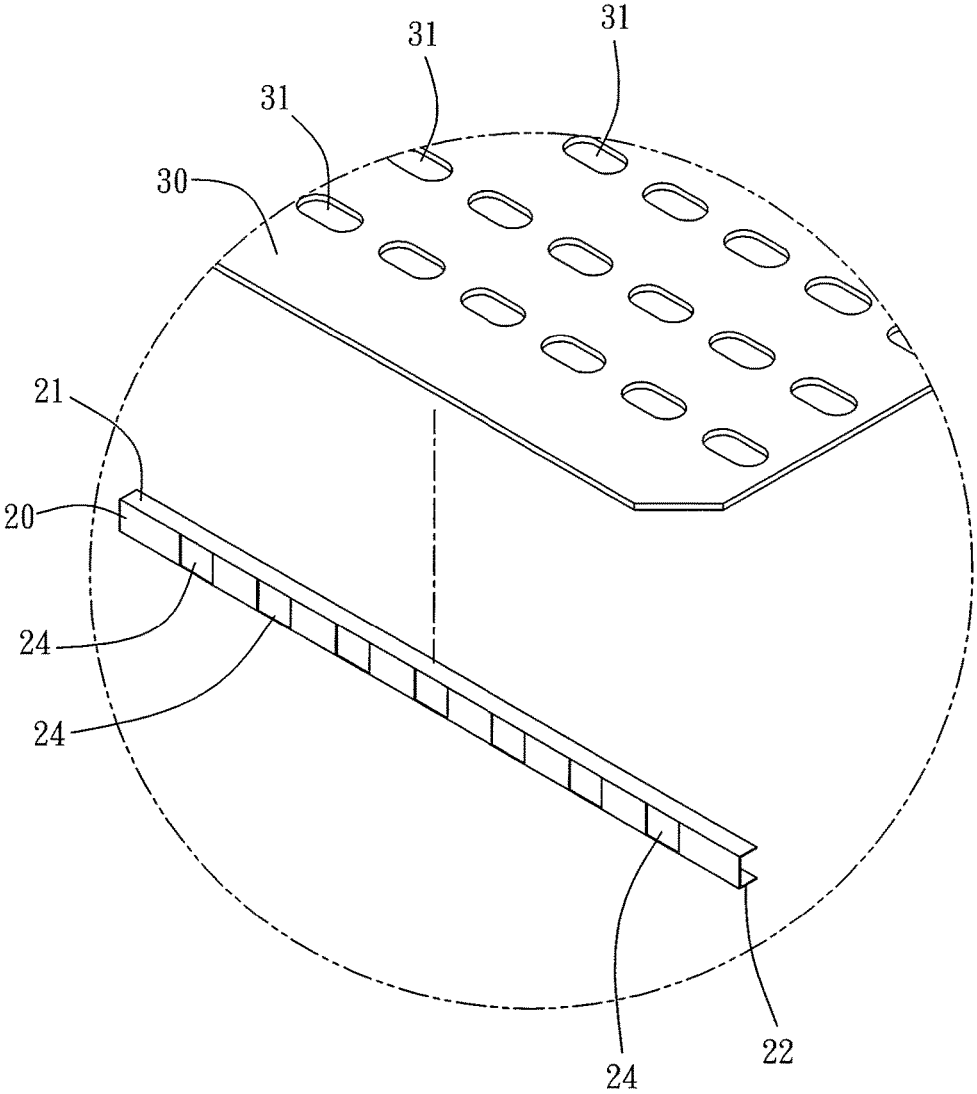
FIG. 4 is a locally enlarged exploded perspective view of the air cushion as shown in FIG. 1.
Figure 5:
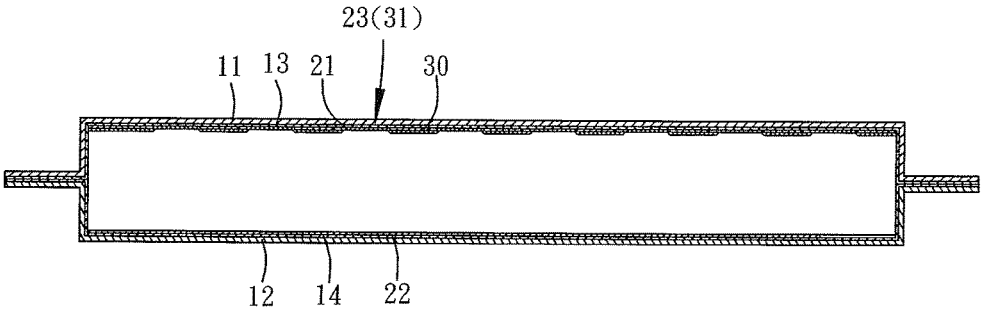
FIG. 5 is a cross-sectional view of the air cushion taken along line 5-5 as shown in FIG. 1.
Figure 6:
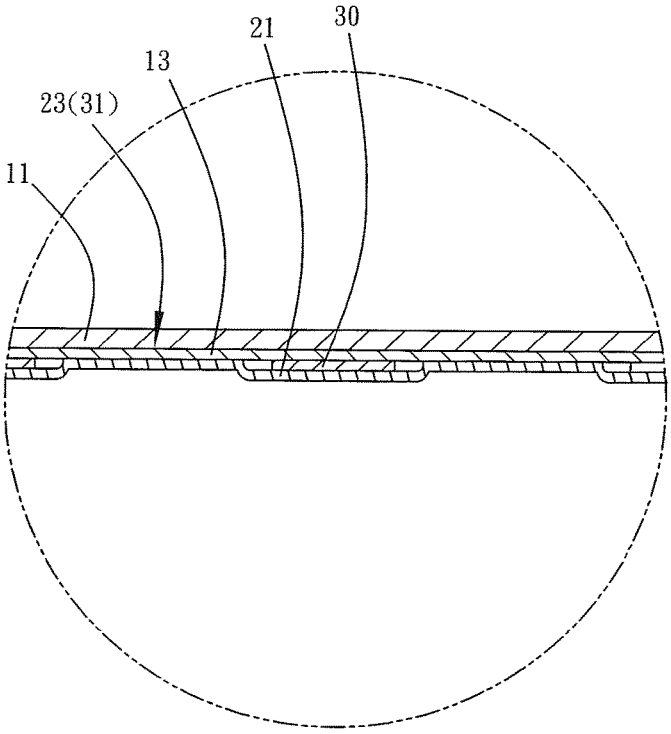
FIG. 6 is a locally enlarged view of the air cushion as shown in FIG. 5.

Referring to the drawings and initially to FIGS. 1-6, an air cushion in accordance with the preferred embodiment of the present invention comprises a cushion body 10 and an air nozzle 15 mounted on the cushion body 10.

The cushion body 10 includes an upper surface layer 11, a lower surface layer 12 juxtaposed to the upper surface layer 11, an upper plastic film layer 13 mounted on the upper surface layer 11, a lower plastic film layer 14 mounted on the lower surface layer 12 and combined with the upper plastic film layer 13, a plurality of flexible pull straps 20 mounted between the upper surface layer 11 and the lower surface layer 12, and a warming layer 30 mounted between the upper surface layer 11 and the lower surface layer 12.

Each of the upper plastic film layer 13 and the lower plastic film layer 14 is made of an air impermeable plastic material, such as a thermoplastic urethane (TPU) and the like. The upper plastic film layer 13 and the lower plastic film layer 14 are sealed and combined together by bonding.

The pull straps 20 are located between the upper plastic film layer 13 and the lower plastic film layer 14 and are arranged in parallel with each other. Each of the pull straps 20 is made of a plastic material, such as a thermoplastic urethane (TPU) and the like. Each of the pull straps 20 has a substantially U-shaped profile and has an upper end provided with a first connecting portion 21 and a lower end provided with a second connecting portion 22. The first connecting portion 21 and the second connecting portion 22 of each of the pull straps 20 are provided with a plurality of bonding portions 23 between the upper plastic film layer 13 of the upper surface layer 11 and the lower plastic film layer 14 of the lower surface layer 12.

The warming layer 30 is made of a warming cotton, an aluminum foil or a material that can absorb a heat source. The warming layer 30 is located between the upper surface layer 11 and the first connecting portion 21 of each of the pull straps 20. The warming layer 30 is provided with a plurality of through holes 31.

In the preferred embodiment of the present invention, the first connecting portion 21 of each of the pull straps 20 and the upper surface layer 11 are bonded mutually in a point-to-point manner to define the bonding portions 23, and the second connecting portion 22 of each of the pull straps 20 and the lower surface layer 12 are bonded mutually in a point-to-point manner to define the bonding portions 23. Each of the pull straps 20 is provided with a plurality of slots 24 arranged between the first connecting portion 21 and the second connecting portion 22.

In the preferred embodiment of the present invention, each of the through holes 31 of the warming layer 30 respectively corresponds to one of the bonding portions 23 between the first connecting portion 21 of each of the pull straps 20 and the upper surface layer 11. Preferably, each of the through holes 31 of the warming layer 30 has an inner diameter greater than the maximum outer diameter of each of the bonding portions 23. Preferably, the through holes 31 of the warming layer 30 have a number the same as that of the bonding portions 23.

In assembly, the second connecting portion 22 of each of the pull straps 20 is bonded onto the lower plastic film layer 14 of the lower surface layer 12. Then, the warming layer 30 is placed on and located above the first connecting portion 21 of each of the pull straps 20. Then, the upper plastic film layer 13 of the upper surface layer 11 is placed on and located above the warming layer 30. Then, the first connecting portion 21 of each of the pull straps 20 and the upper plastic film layer 13 of the upper surface layer 11 are fused and bonded mutually by a fusing machine in a point-to-point manner to define the bonding portions 23 which align with the through holes 31 of the warming layer 30. Finally, the peripheries of the upper surface layer 11 and the lower surface layer 12 are sealed and fused so that the upper surface layer 11 and the lower surface layer 12 are combined together. Thus, the air cushion is assembled. At this time, a plurality of air channels are defined between the pull straps 20 and the cushion body 10 to allow passage of air.

In use, when the air nozzle 15 is opened, the ambient air is introduced through the air nozzle 15 into the cushion body 10 so that the air flows through the channels between the pull straps 20 and the cushion body 10 and the slots 24 of each of the pull straps 20 to inflate and expand the cushion body 10 for use with a user. In such a manner, when the cushion body 10 is placed on the ground, the upper surface layer 11 and the lower surface layer 12 are isolated by the warming layer 30 and the pull straps 20 to prevent the moisture of the ground from being infiltrated through the lower surface layer 12 into the upper surface layer 11 so that the cushion body 10 has a warming effect to the user when the user lies on the upper surface layer 11 of the cushion body 10 to provide a comfortable sensation to the user.

Accordingly, the warming layer 30 of the cushion body 10 provides a warming function to the user to maintain the warming effect exactly and efficiently. In addition, the bonding portions 23 align with the through holes 31 of the warming layer 30 so that when the first connecting portion 21 of each of the pull straps 20 and the upper plastic film layer 13 of the upper surface layer 11 are connected by the bonding portions 23, the through holes 31 of the warming layer 30 will not interfere with connection of the first connecting portion 21 and the upper plastic film layer 13, so as to achieve an exact bonding connection. Further, the warming layer 30 is placed on and limited by the first connecting portion 21 of each of the pull straps 20, and the through holes 31 of the warming layer 30 are limited by the bonding portions 23 between the first connecting portion 21 of each of the pull straps 20 and the upper plastic film layer 13 of the upper surface layer 11, so that the warming layer 30 is positioned and will not be moved, thereby preventing inflation of the cushion body 10 from being affected by the warming layer 30. Further, the ambient air is introduced through the air nozzle 15 into the cushion body 10 and is evenly circulated through the channels between the pull straps 20 and the cushion body 10 and through the slots 24 of each of the pull straps 20 so that the cushion body 10 is inflated easily and quickly.

Figure 7:
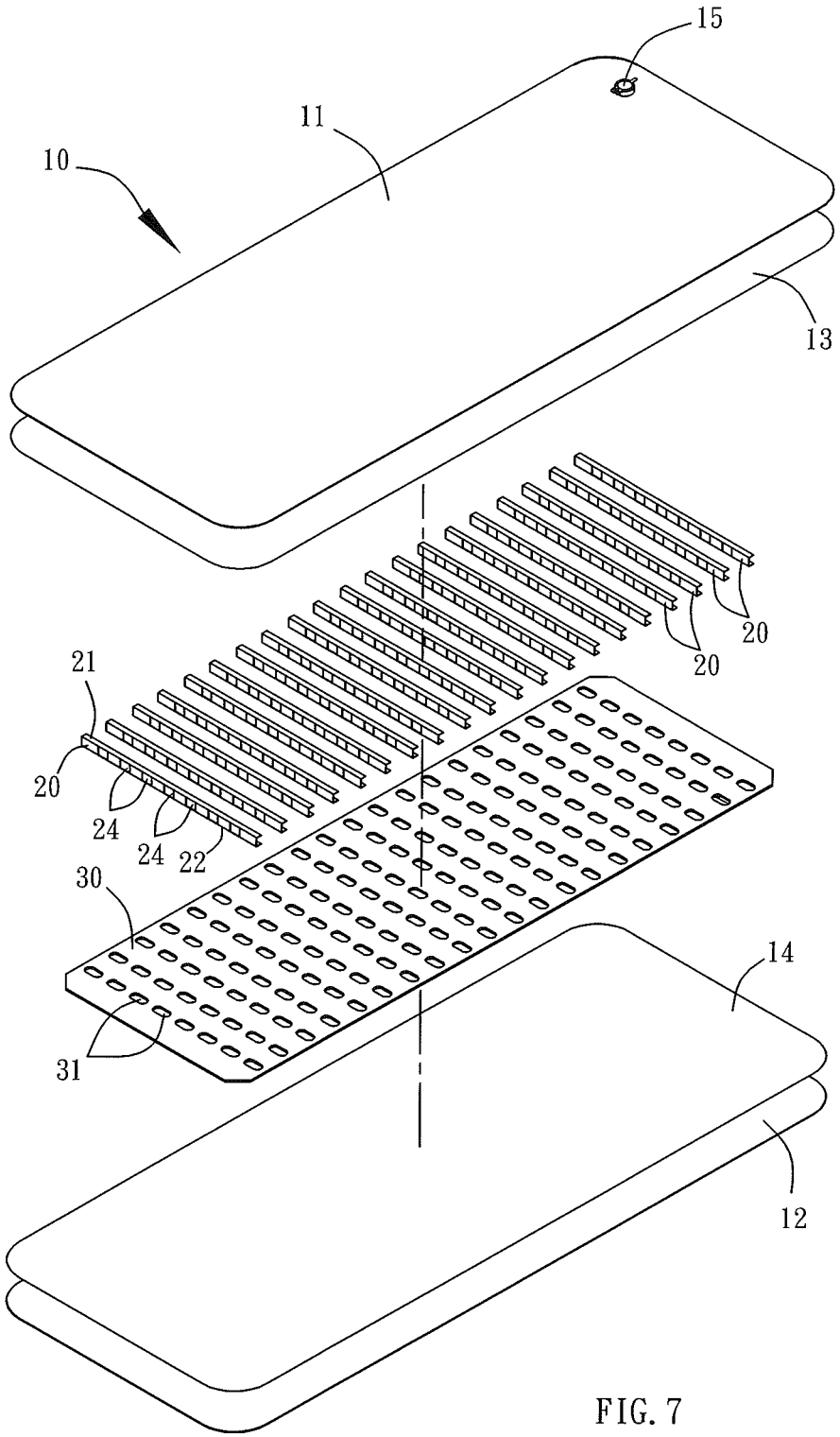
FIG. 7 is an exploded perspective view of an air cushion in accordance with another preferred embodiment of the present invention.

Referring to FIG. 7, the warming layer 30 is located between the lower surface layer 12 and the second connecting portion 22 of each of the pull straps 20.

Figure 8:
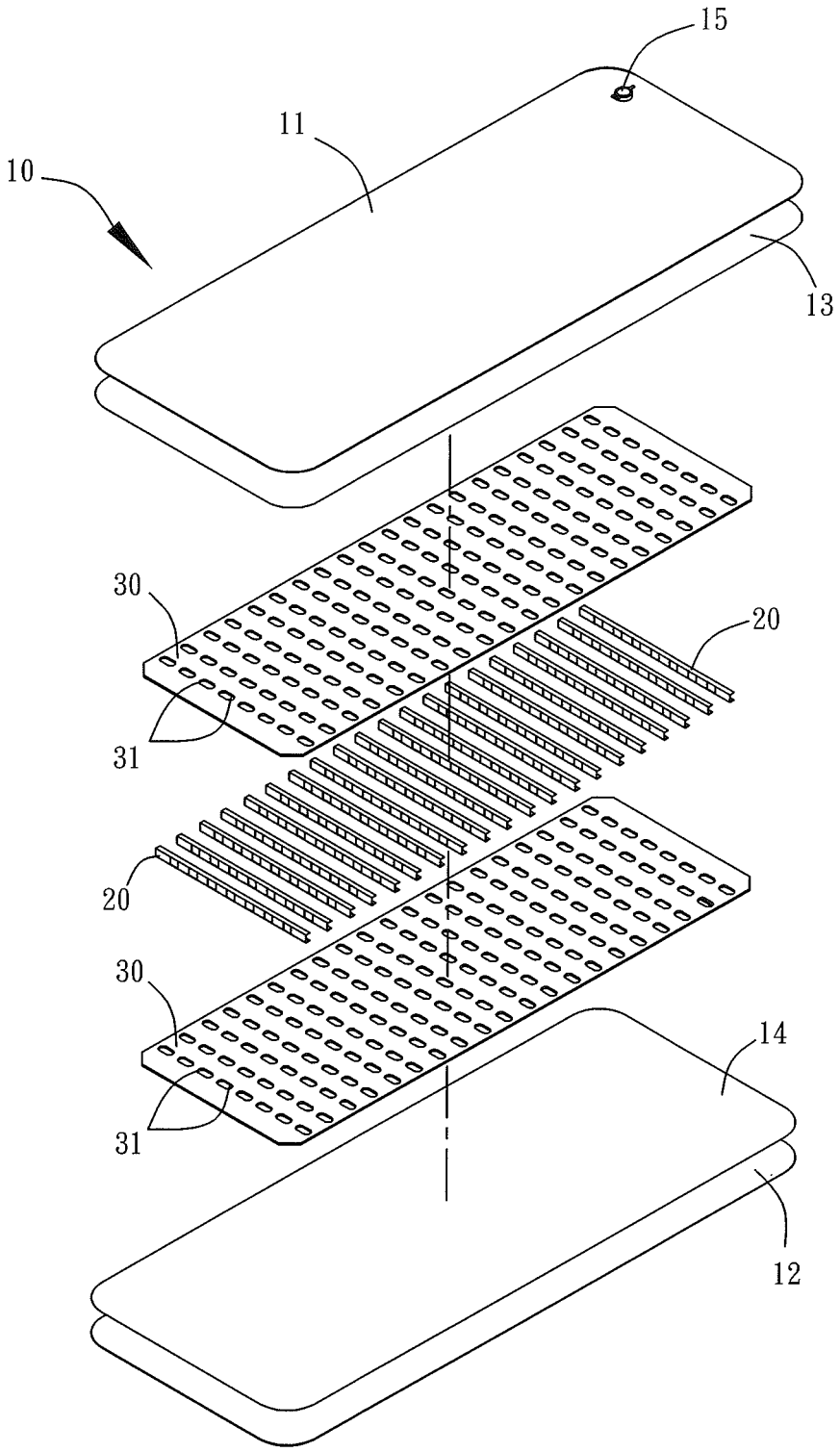
FIG. 8 is an exploded perspective view of an air cushion in accordance with a further preferred embodiment of the present invention.
Figure 9:
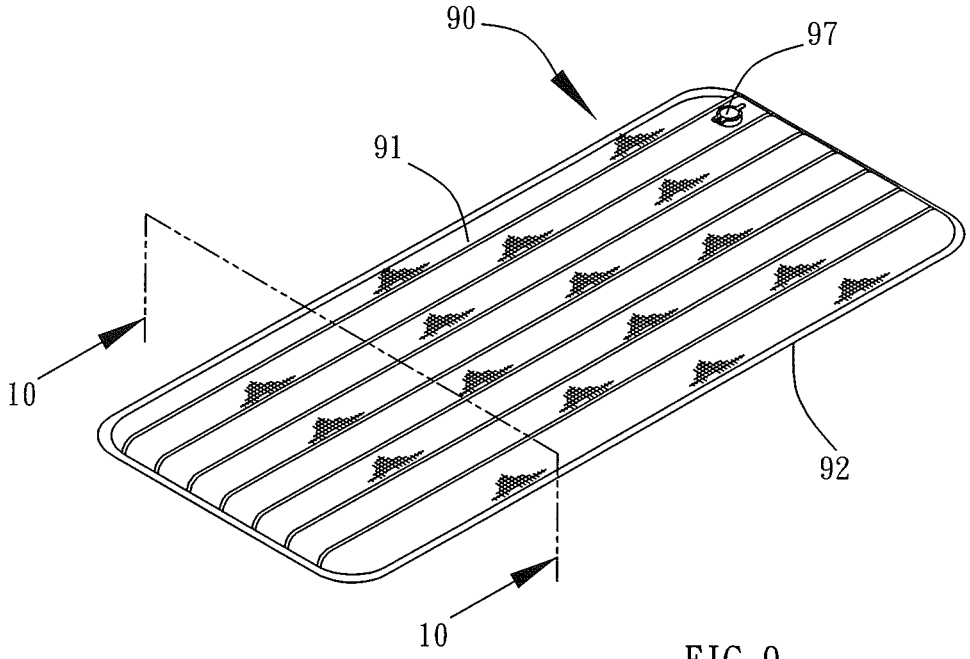
FIG. 9 PRIOR ART
FIG. 9 is a perspective view of a conventional air cushion in accordance with the prior art.
Figure 10:
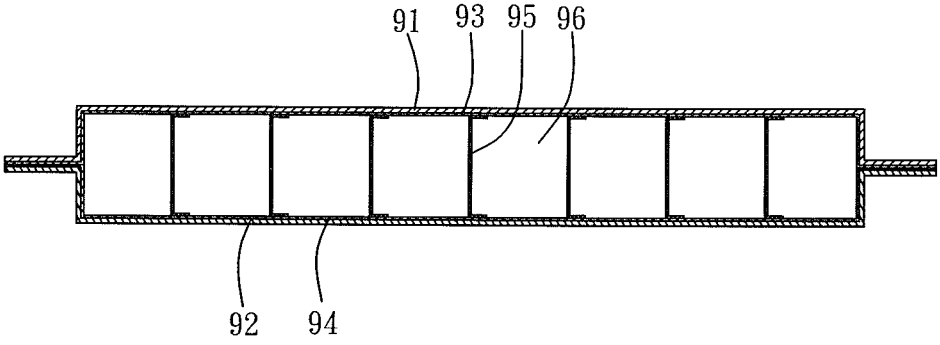
FIG. 10 PRIOR ART
FIG. 10 is a cross-sectional view of the conventional air cushion taken along line 10-10 as shown in FIG. 9.
Figure 11:
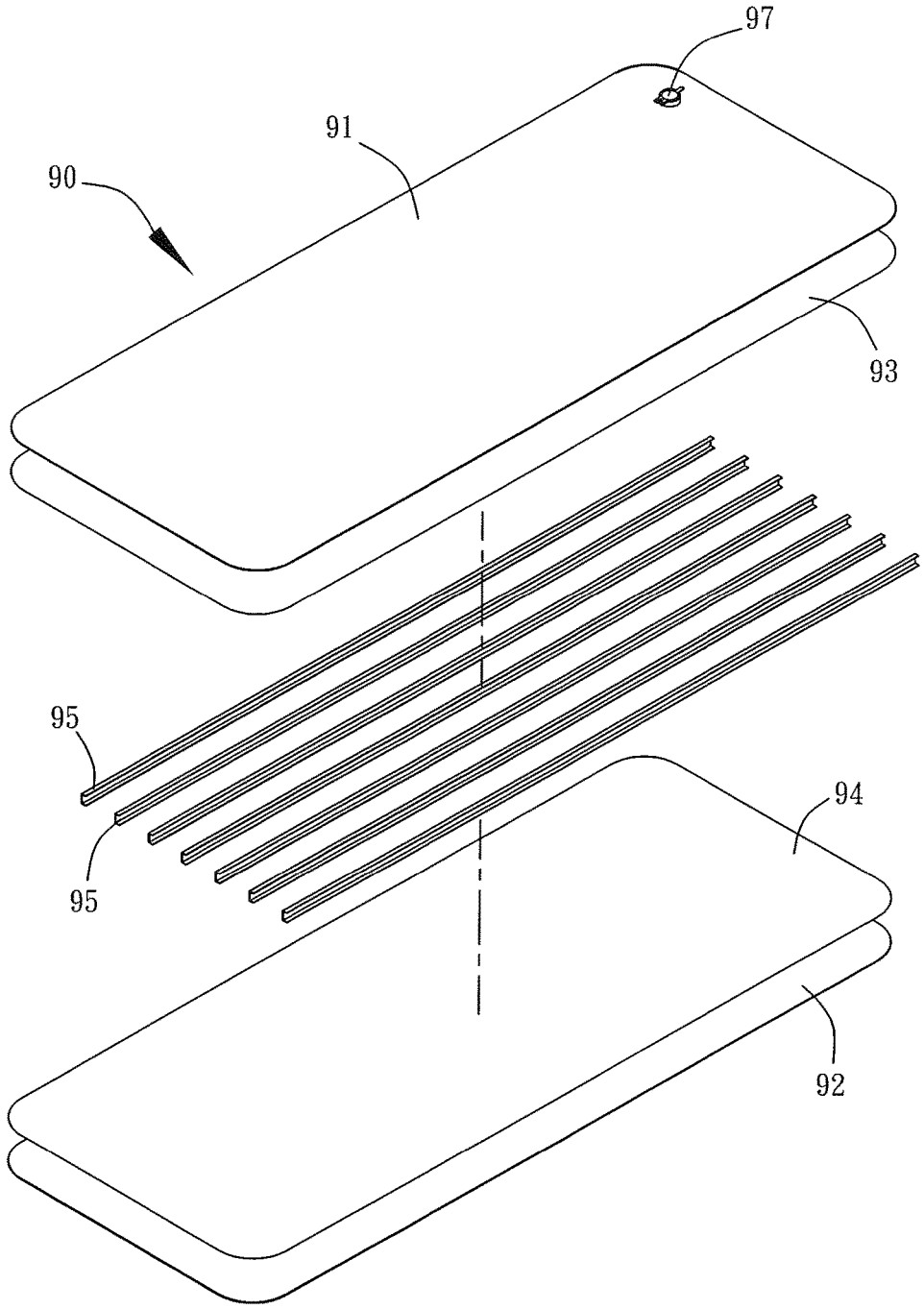
FIG. 11 PRIOR ART
FIG. 11 is an exploded perspective view of the conventional air cushion as shown in FIG. 9.

Referring to FIG. 8, the warming layer 30 is respectively located between the upper surface layer 11 and the first connecting portion 21 of each of the pull straps 20 and between the lower surface layer 12 and the second connecting portion 22 of each of the pull straps 20.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An air cushion comprising:

a cushion body; and an air nozzle mounted on the cushion body;

wherein:

the cushion body includes:

an upper surface layer;

a lower surface layer juxtaposed to the upper surface layer;

an upper plastic film layer mounted on the upper surface layer;

a lower plastic film layer mounted on the lower surface layer and combined with the upper plastic film layer;

a plurality of pull straps mounted between the upper surface layer and the lower surface layer; and a warming layer mounted between the upper surface layer and the lower surface layer;

each of the pull straps has an upper end provided with a first connecting portion and a lower end provided with a second connecting portion;

the first connecting portion and the second connecting portion of each of the pull straps are provided with a plurality of bonding portions between the upper plastic film layer of the upper surface layer and the lower plastic film layer of the lower surface layer;

the warming layer is located between the upper surface layer and the first connecting portion of each of the pull straps; and the warming layer is provided with a plurality of through holes.

2. The air cushion of claim 1, wherein the first connecting portion of each of the pull straps and the upper surface layer are bonded mutually in a point-to-point manner to define the bonding portions, and the second connecting portion of each of the pull straps and the lower surface layer are bonded mutually in a point-to-point manner to define the bonding portions.

3. The air cushion of claim 1, wherein each of the pull straps is provided with a plurality of slots arranged between the first connecting portion and the second connecting portion.

4. The air cushion of claim 1, wherein the warming layer is made of a warming cotton, an aluminum foil or a material that can absorb a heat source.

5. The air cushion of claim 1, wherein each of the through holes of the warming layer respectively corresponds to one of the bonding portions between the first connecting portion of each of the pull straps and the upper surface layer.

6. The air cushion of claim 1, wherein each of the through holes of the warming layer has an inner diameter greater than the maximum outer diameter of each of the bonding portions.

7. The air cushion of claim 1, wherein the through holes of the warming layer have a number the same as that of the bonding portions.

8. The air cushion of claim 1, wherein the warming layer is located between the lower surface layer and the second connecting portion of each of the pull straps.

9. The air cushion of claim 1, wherein the warming layer is respectively located between the upper surface layer and the first connecting portion of each of the pull straps and between the lower surface layer and the second connecting portion of each of the pull straps.

* * * * *